United States Patent [19]

Troncoso, Jr. et al.

[11] 4,041,926

[45] Aug. 16, 1977

[54] BOWSTRING RELEASE DEVICE

[76] Inventors: Fernando Troncoso, Jr., 1851 S. Orange Ave., Monterey Park, Calif. 91754; Scott Lewis Bomar, 2910 S. Rita Way, Santa Ana, Calif. 92704

[21] Appl. No.: 659,099

[22] Filed: Feb. 18, 1976

[51] Int. Cl.[2] ..... F41B 5/00

[52] U.S. Cl. ..... 124/35 A

[58] Field of Search ..... 124/35 A, 30 R, 24 R, 124/23 R, 88, 90, 41 A

[56] References Cited

U.S. PATENT DOCUMENTS

| | | | |
|---|---|---|---|
| 1,542,159 | 6/1925 | Maxwell | 124/35 A |
| 2,488,597 | 11/1949 | Konold | 124/35 A |
| 2,819,707 | 1/1958 | Kayfes et al. | 124/35 A |
| 2,936,749 | 5/1960 | Chellstorp | 124/35 A |
| 3,055,354 | 9/1962 | Gates | 124/88 |
| 3,446,200 | 5/1969 | Gross | 124/35 A X |
| 3,461,852 | 8/1969 | Brothers | 124/35 A |
| 3,921,615 | 11/1975 | Dodge | 124/35 A |
| 3,952,720 | 4/1976 | Wilson | 124/35 A |

*Primary Examiner*—Richard C. Pinkham
*Assistant Examiner*—William R. Browne
*Attorney, Agent, or Firm*—Donald E. Nist

[57] ABSTRACT

The improved archery bowstring release device of the invention includes a frame, a pair of opposable jaws pivotably connected to the front of the frame with the bowstring-retaining ends of the jaws at the front thereof and with the opposite or rear ends thereof defining a space when the front ends abut. A plunger with a specially configured head having a wider diameter at its front end is slideably disposed in the frame, the plunger head being urged forward into the space by a spring so as to keep the front ends of the jaws closed, trapping a bowstring therein. A trigger is secured to the plunger and enables the archer to urge the plunger rearward in the frame and out of the space so as to permit the front ends of the jaws to open and release the trapped bowstring. An adjustable stop may be provided to finely control the extent to which the head can be urged into the space and thus the extent of rearward movement of the trigger necessary to withdraw the head from the space. The configured head assures that opening of the front ends of the jaws during withdrawal of the head will be sudden and unexpected. An adjustable collar, usable on the archer's wrist or elbow, is attached to the frame by a cord to enable the archer to draw the bowstring by the release device. The device permits extremely accurate archery bow shooting.

11 Claims, 4 Drawing Figures

BOWSTRING RELEASE DEVICE

BACKGROUND

1. Field of the Invention

The present invention generally relates to archery devices and more particularly to an improved archery bowstring release device.

2. Prior Art

Various forms of mechanical archery bowstring release devices are becoming increasingly popular, because they facilitate accurate shooting more easily and more rapidly than do the older, more traditional finger tabs, gloves and finger stalls. Thus, mechanical release devices usually feature essentially single point contact with the bowstring. When the drawn bowstring is released from such a device, the release is usually relatively rapid and at a point usually more or less in line with the centerline of the bow so that the bowstring delivers most of its thrust directly along the major axis of the arrow. Accordingly, the arrow has a tendency to bend less than when finger tabs, gloves or finger stalls are used to draw the bowstring and release it. When tabs, etc. are used the bowstring tends to roll off the fingers or tab and be deflected sidewards during release, thus following a serpentine path and failing to deliver most of its energy directly along the major axis of the arrow. A substantial portion of the energy is delivered at an angle to the major arrow axis, thus causing the arrow to bend. The less bending an arrow goes through during shooting, generally the more accurately it can be shot. Lighter, thinner arrows which otherwise would bend excessively can be shot with mechanical releases, thus increasing arrow cast and accuracy, the latter by decreasing the angle at which the arrow enters the target.

The most important contribution of mechanical releases to shooting accuracy, however, is the increased ability of the archer to release the bowstring almost the same way from shot to shot instead wide fluctuations in manner of release from shot to shot as is encountered when using a plurality of fingers in a glove, tab or finger stall arrangement. Because of this, mechanical releases have become very popular. Unfortunately, most conventional mechanical releases still have a number of disadvantages. Thus, many such releases are essentially single solid curved hooks, which easily slip from the bowstring while the arrow is being drawn. Such an occurrence will result in a lost or dropped arrow, very important in a tournament. Moreover, with those single hook devices, there is no way of determining exactly how far, from shot to shot, the hook must be turned or rotated sideways to permit the bowstring to be released. Although it is desirable not to know when release will occur, still there must be uniformity of release device movement from shot to shot, or timing and coordination are destroyed or debilitated. Moreover, rotation of the hook is basically an unnatural movement and tends to move the draw fingers away from preselected face anchor points, which are important for shooting accuracy.

Rope type mechanical release devices also require hand rotation to allow the rope to slip off a retaining peg and thus effect release of the arrow. Various other styles and types of mechanical release devices, many of which are complicated and expensive, have analogous problems.

Accordingly, there is a need for an improved durable, easy to use mechanical release device which features essentially point contact release of a bowstring without requiring rotation of the draw hand fingers or any other unnatural movement, which prevents inadvertant premature shooting of the arrow and which is fully adjustable for maximum tunability to the needs of the individual archer. Such a device should also eliminate anticipation of the shot, which would result in flinching and shooting inaccuracy.

SUMMARY OF THE INVENTION

The improved archery bowstring release device of the present invention satisfies the foregoing needs. It is constructed substantially as set forth in the Abstract above. With this device, the bowstring can be fully drawn without engaging the trigger. Moreover, the bowstring is held completely safe against release by a positive locking arrangement. The trigger is adjustable for length of travel and is aligned so that it is gripped at full draw and moved slightly to cause the bowstring release without warning, all without rotation of the draw fingers. Instead release is effected merely with tightening of the back muscles behind the shoulder blades, a completely natural form of movement well known to archers and which assures maintaining of proper stance, bow alignment and follow through during and after the shot, for maximum results. Other features of the improved release device are set forth in the following detailed description and accompanying drawings.

DRAWINGS

DETAILED DESCRIPTION

Figures 1, 2, 3, 4:
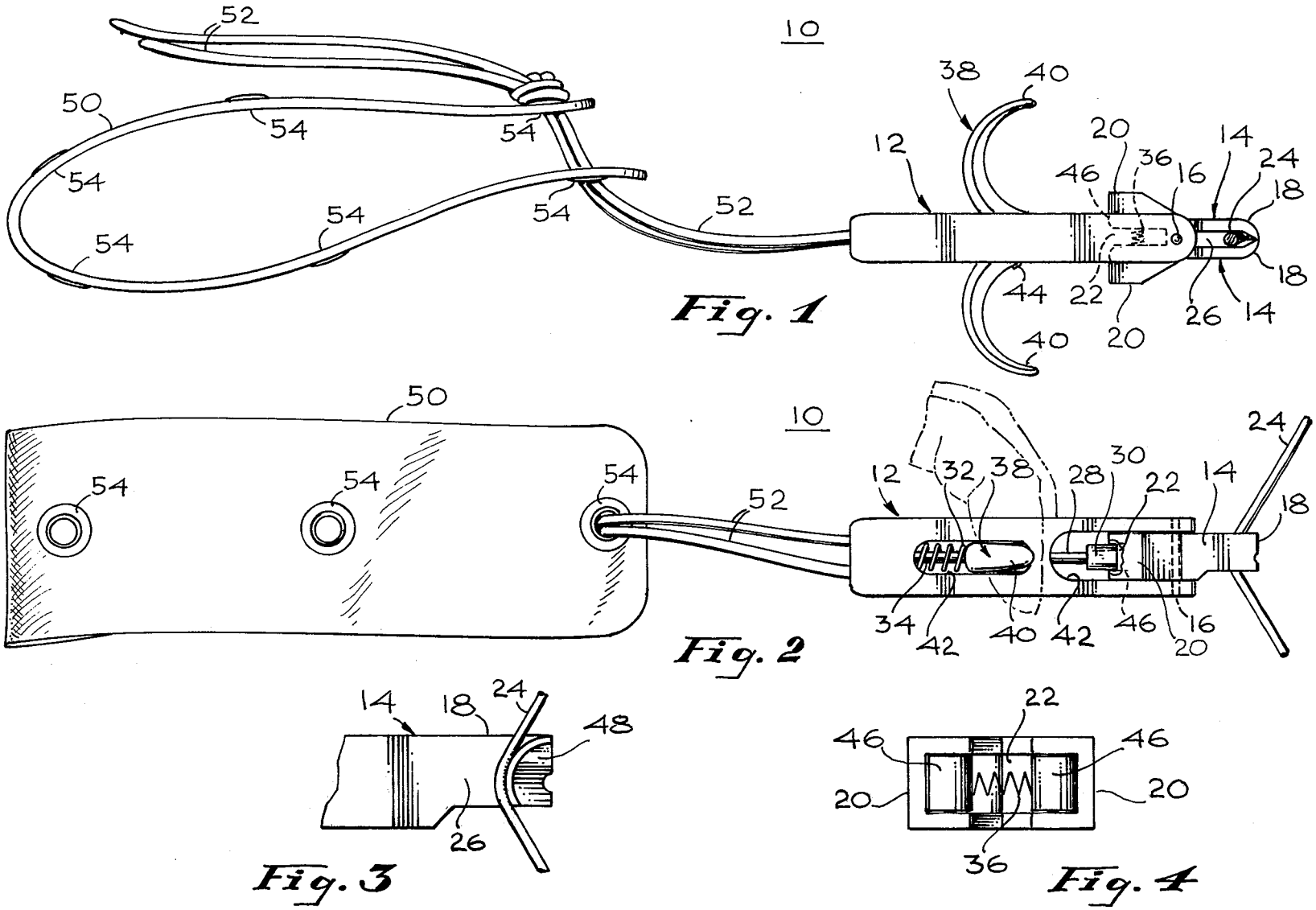
FIG. 1 is a schematic top plan view of a preferred embodiment of the improved archery bowstring release device of the present invention.
FIG. 2 is a schematic side elevation of the device of FIG. 1.
FIG. 3 is an enlarged schematic fragmentary side elevation of the front end of one of the pair of jaws of the device of FIG. 1.
FIG. 4 is an enlarged schematic fragmentary rear elevation of the rear ends of the jaws of FIG. 1, said rear ends being shown in the spread space-defining position and without plunger of the device in the space between said rear ends.

Now referring more particularly to FIGS. 1 and 2 of the accompanying drawings, a preferred embodiment of the improved release device of the present invention is schematically depicted. Thus, device 10 is shown which includes an elongated frame 12 and a pair of opposable jaws 14 pivotably connected to the front end of frame 12 via a pin 16. Jaws 14 include curved front ends 18 and flared rear ends 20, the latter defining a plunger-receiving space 22 (FIG. 4) therebetween when ends 14 abut, as shown in FIG. 1. Ends 14 when abutting can hold a bowstring 24 in a space 26 defined thereby as shown.

As shown more particularly in FIG. 2, device 10 also includes an elongated plunger 28 slideably disposed longitudinally in frame 12 rearwardly of jaws 14. Plunger 28 includes an enlarged head 30 of special configuration at its front end, which head 30 is biased forward into space 22 by a coil spring 32 disposed in frame 12 around rod portion 34 of plunger 28. When head 30 is in the position shown in FIG. 2, rear ends 20 are positively forced apart and front-ends 18 are forced closed to trap bowstring 24 in space 26. A small coil spring 36 (FIG. 4) may be disposed between rear ends 20 to urge them apart, as more particularly set forth hereinafter.

A trigger 38 is secured to rod 34 of plunger 28 and includes a pair of forwardly curved wings 40 extending lateral of frame on opposite sides thereof through openings 42 in frame 12. Wings 40 are in a generally horizontal plane. The portion of frame 12 which defines the forward edge of each opening 42 acts as a stop against further forward travel of trigger 38. A rearwardly angled set screw 44 running through one wing 40 and into rod 34 permits adjustment of the forwardmost position of head 30 in space 22 and thus the extent of travel of trigger 38 rearwardly against the bias of spring 32 which is necessary to withdraw head 30 from space 22 so as to permit ends 18 of jaws 14 to open and release bowstring 24. Thus, fine adjustment of trigger 38 can be made to suit individual needs.

Rear ends 20 defining space 22 are lined with hard smooth curved bearing surfaces which facilitate a smooth release of the bowstring. In order to assure that the release of the bowstring will be sudden and unanticipated, so as to prevent flinching, head 30 can be slightly tapered from front to rear so that it has a slightly greater diameter at its front end than at its rear end. When trigger 38 is moved rearwardly, no slippage of head 30 will occur as the front end of head 30 approaches in its rearward withdrawal the rear end of space 22, such as would cue the archer that the release can be expected. In order to further facilitate smoothness of the bowstring release so as to minimize vibration and wear of the bowstring, front ends 18 in the areas 48 against which the bowstring 24 presses when trapped, as in FIG. 3, are fully radiused and sloped. Thus, minimum stress on bowstring 24 occurs.

Frame 12 is connected at its rear end to an adjustable collar 50 by a cord 52, the strands of which run through one pair 54 of a series of pairs 54 of eyeletted holes in collar 50. The length of cord 52 is adjustable, as by knotting it, so that collar 54 can be fitted around the wrist or elbow of the draw arm of the archer using device 10.

When device 10 is to be used, trigger 38 is retracted or moved rearwardly sufficiently to remove head 30 from space 22, whereupon rear ends 20 can be pinched together by the fingers, against the bias of small spring 36, thus opening front ends 18 and allowing bowstring 24 to be passed into space 26. Ends 20 are then released, whereupon spring 36 forces them apart and ends 18 together. Trigger 38 is also released, head 30 being forced into space 22 by spring 32, thus locking ends 18 together in abutting position. Collar 50 is then (or previously) fitted around the archer's wrist or elbow of his draw arm, the bow is gripped in the hand of his other arm, his proper stance is taken and the bowstring is drawn to full draw by moving device 10 rearwardly by collar 50, usually without touching trigger 38. Alignment is then checked at full draw, aim is taken at the target and the forefinger and middle finger of the draw hand are then placed lightly against wings 40. The archer's back muscles between the shoulder blades are then drawn together, causing the shoulder blades to move towards each other and resulting in the slight rearward movement of trigger 38 relative to frame 12 necessary to cause removal of head 30 from space 22 and, without warning, sudden opening of ends 18 and release of bowstring 24. All this occurs while the archer continues his stance, back muscle pressure, aim and follow through for a well executed shot with extreme accuracy possible. The above-described procedure can be carried out shot after shot with highly satisfactory results.

Device 10 thus is easy to use. It produces excellent results. It is also durable, can easily be adjusted, as by collar 50, cord 52 and set screw 44, to meet the individual archer's needs, and can be made of inexpensive yet attractive and durable materials. For example, frame 12 and trigger 38 can be of metal, such as aluminum or plastic etc., while jaws 14 preferably are of metal.

Various modifications, changes and alterations can be made in the device of the present invention and in its components and their parameters. All such modifications, changes and alterations as are within the scope of the appended claims form part of the present invention.

What is claimed is:

1. An improved archery bowstring release device, said device comprising, in combination:

a. a frame;

b. a pair of opposable spring biased jaws pivotably connected to said frame and having abuttable bowstring-retaining ends and opposite plunger engaging ends, the latter end when biased part defining a plunger space therebetween when said bowstring-retaining ends abut each other;

c. a trigger actuated plunger slideably disposed in said frame;

d. means biasing a portion of said plunger into said space to prevent movement of the jaws and to positively hold only a bowstring in bowstring-retaining position free of an arrow, the leading or jaw engaging end of said plunger portion having a diameter greater than that of the trailing end of said plunger portion so as to assure sudden non-creep opening of said jaws; and, e. a trigger connected to said plunger for urging said plunger against said biasing and out of said space, thereby permitting said string-retaining ends to open and release a bowstring therefrom during shooting of an archery bow.

2. The improved release device of claim 1 wherein said bowstring-retaining ends are front ends of said jaws and wherein said opposite ends are rear ends of said jaws.

3. The improved release device of claim 2 wherein said jaws are pivotably connected at only a single point to said frame so as to permit free pivoting of said jaws without torquing of said bowstring during release.

4. The improved release device of claim 3 wherein said single pivot point is adjacent the front end of said frame and wherein said plunger and trigger are disposed rearwardly of said jaws.

5. The improved release device of claim 4 wherein said plunger is spring biased forwardly.

6. The improved release device of claim 1 wherein said leading end comprising a head having a greater diameter at its front end than rearwardly thereof, wherein said greater diameter is in the same plane as the plane of movement of said jaws, and wherein said jaw space is lined by hard smooth curved walls, whereby said sudden opening can be effected without anticipation.

7. The improved release device of claim 6 wherein said device includes adjustable means to regulate the forward most position of said head in said space and thereby the extent said trigger must be urged rearwardly to permit said jaw front ends to open.

8. The improved release device of claim 6 wherein said trigger comprises a pair of wings extending laterally of said frame.

9. The improved release device of claim 8 wherein said trigger wings are curved to each receive a finger of an archer and are disposed in a generally horizontal plane.

10. The improved release device of claim 9 wherein said jaw space is lined by hard smooth curved bearing walls to facilitate said sudden opening and wherein said front ends define a smoothly radiused string groove to facilitate a smooth bowstring release.

11. The improved release device of claim 10 wherein said frame is elongated and the rear end thereof is connected by a cord to an adjustable draw collar for attachment to either of an archer's wrist or elbow for movement of said release device in drawing of a bowstring by said release device during shooting of an archery bow.

* * * * *